United States Patent [19]

Koch

[11] Patent Number: 4,468,887

[45] Date of Patent: Sep. 4, 1984

[54] WINDOW LIFTING MECHANISM, PARTICULARLY FOR MOTOR VEHICLES

[75] Inventor: Wilhelm Koch, Ebelsbach, Fed. Rep. of Germany

[73] Assignee: Brose Fahrzeugteile GmbH & Co. Kommanditgesellschaft, Fed. Rep. of Germany

[21] Appl. No.: 379,906

[22] Filed: May 19, 1982

[30] Foreign Application Priority Data

Jun. 4, 1981 [DE] Fed. Rep. of Germany ..... 3122202

[51] Int. Cl.[3] ..... E05F 11/48

[52] U.S. Cl. ..... 49/352; 49/360

[58] Field of Search ..... 49/352, 360, 348, 349

[56] References Cited

U.S. PATENT DOCUMENTS

| | | | |
|---|---|---|---|
| 3,930,339 | 1/1976 | Jander | 49/352 |
| 4,109,417 | 8/1978 | Fogarollo | 49/352 |
| 4,199,899 | 4/1980 | Müling | 49/352 |
| 4,235,046 | 11/1980 | Hess et al. | 49/352 |

*Primary Examiner*—Philip C. Kannan

*Attorney, Agent, or Firm*—Toren, McGeady and Stanger

[57] ABSTRACT

In a window lifting mechanism 10 for motor vehicles, with an engagement member 16 which engages at a window pane, a slide member 24 which is connected with the engagement member and is supported to be slidable at a guide rail 26, and a cable drive 12 to move the engagement member 16 along the guide rail 26, the engagement member 16 is supported at the slide member 24 so as to be slidable in the longitudinal direction X of the guide rail 26, i.e. simply by attaching the engagement member 16 at a bearing part which in turn is supported to be slidable at the slide member 24 in the longitudinal direction X. With this simple arrangement an increase in the lift of the window lifting mechanism at a specified length c of the guide rail 26 is achieved, while maintaining the mechanical stability of the window lifting mechanism with respect to tilting motions of the window pane which lie in the plane of the window pane. Preferably a steel band loop 44 is used as the bearing part. In an additional embodiment, the steel band is slidably supported directly at the guide rail which is constructed as a C-rail, wherein at least one end of the guide rail a deflection for the band is provided.

22 Claims, 10 Drawing Figures

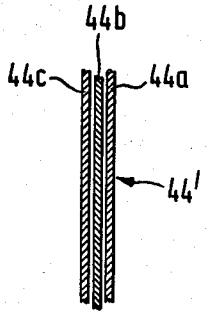
FIG. 8
FIG. 9
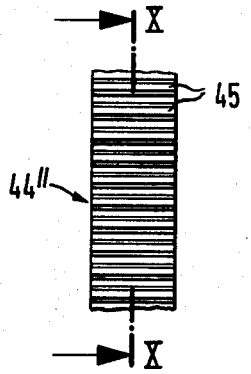
FIG. 10
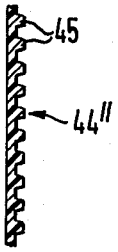

WINDOW LIFTING MECHANISM, PARTICULARLY FOR MOTOR VEHICLES

The subject matter of the application is a window lifting mechanism, particularly for motor vehicles, with a lifting rail which engages at a window pane, a slide member which is connected with the lifting rail and is slidably supported at a guide rail, and a drive which engages at the lifting rail in order to move the lifting rail along the guide rail, wherein the lifting rail is slidable with respect to the slide member essentially in the longitudinal direction of the guide rail by means of a linear guidance which connects the lifting rail and the slide member. The linear guidance is essentially of rigid construction in relation to tilting motions of the lifting rail relative to the slide member, which tilting motions lie in the plane of the window pane. With this arrangement one achieves at a specified guide rail length an increase in lift compared to window lifting mechanisms with rigid connection between the lifting rail and the slide member, i.e. an increase by the lift of motion of the lifting rail relative to the slide member.

It is the task of the invention to provide a linear guidance which is characterized by particularly simple construction and low manufacturing and assembly costs.

This task is solved by means of at least one bearing part which is attached at the lifting rail and is supported to be slidable at the slide member in the longitudinal direction of the guide rail. Therefore only a single part is necessary which connects the lifting rail with the slide member.

In order to increase the stiffness of the linear guidance, constructed in this manner, with respect to the tilting motions which lie in the plane of the window pane and thus improve guidance of the window pane by means of the window lifting mechanism, it is suggested that the bearing part is of oblong construction in the longitudinal direction of the lifting rail and that at least one of the longitudinal ends of the bearing part is constructed so as to be deflectable about the corresponding, closest, longitudinal end of the slide member. Due to the oblong construction of the bearing part, also relatively high tilting moments can be transferred between the bearing part and the slide member without the occurrence of increased friction or deformation of involved structural parts. Since at least one of the longitudinal ends of the bearing part is deflected around the guide member during movement of the bearing part in direction towards this end in the corresponding end position, it does not project beyond the slide member, so that an increase in structural height of the window lifting mechanism is prevented.

The deflectable bearing part is preferably formed by a deformable band member which lies at least in the area of the lifting rail essentially in a plane which is parallel to the plane of the window pane. Such a bearing part is economical to manufacture and is nevertheless adequately stiff with respect to the tilting forces in the plane of the window pane, i.e. in the plane of the band.

The band member is preferably formed by a steel band or a plastic band which may be reinforced by providing transverse ribs or by upsetting the plastic band in the transverse direction.

In a particularly strong arrangement, the band member is formed by a closed band loop with a loop axis which is essentially parallel to the lifting rail. Corresponding tensions of the band loop counteract a deformation of the band member due to tilting forces which always result in an elongation of the band loop. These tensions are particularly high when using a steel band.

In order to further increase the stability of the arrangement against tilting forces, it is suggested that, on the side of the slide member which faces the lifting rail, the band member is guided by means of strips which overlap the longitudinal edges of the band. These guide strips prevent twisting or waving of the band member under high load so that the band remains flat and also reliably transfers high tilting moments.

In some cases of use, particularly in curved window panes, it is advantageous if there is a possibility to change the space between the lifting rail and the guide rail during operation. In order to accomplish this, it is suggested that the band member in the area of its attachment at the lifting rail is provided with recesses at both longitudinal edges in such a way that the resulting band width is less than the inside space between the guide strips. Consequently the band member can also be moved in the space between the guide strips, if necessary.

To obtain additional guidance and thus greater stability, it is suggested that the band member in the region of its attachment to the lifting rail is provided with a guide web which is fitted between the guide strips.

In addition, the guide web may project, on the side of the band member which faces away from the lifting rail, beyond the band member and engage into a guide groove which is constructed at the slide member; this further improves the guidance of the lifting rail at the slide member.

The lifting rail is preferably provided with an engagement plate attached at the band member which, if appropriate, may also be constructed in one piece with the lifting rail.

When the invention is used in a cable window lifting mechanism, it is suggested that at the lifting rail or at the engagement plate a traction cable fastener is installed, preferably molded on. In order to provide a problem-free introduction of tensions of the traction cable into the lifting rail, it is suggested that around the traction cable fastener a loop of the traction cable is placed with cable starting points which are arranged offset with respect to one another in a plane which is perpendicular to the longitudinal direction of the lifting rail. Since the traction cable loops around the fastener, the cable starting points are crossed in relation to the cable deflections provided at the two guide rail ends, i.e. that in a vertical guide rail arrangement, the cable section which originates from the upper cable deflection leads to the bottom cable starting point at the traction cable fastener; the same applies for the lower cable section. Due to this offset arrangement of the cable starting points, at a specified distance of the cable deflections, the lifting rail can be pulled further upwardly or downwardly by the traction cable; and vice versa, at a given lift or given guide rail length the distance of the cable deflections from one another can be decreased which, if necessary, results in further reduction of the structural height of the cable window lifting mechanism.

In order to further improve guidance of the lifting rail or the engagement plate at the slide member, it is suggested that the traction cable fastener rests at at least one guide surface of the slide member which is perpendicular to the plane of the window pane and parallel to the longitudinal direction of the guide rail.

The invention also relates to a window lifting mechanism of surprisingly simple construction in which also an increased lift is achieved in that the band member is slidably supported directly at the guide rail and in that at least at one of the two ends of the guide rail a band deflection is provided. Consequently a band member with the length which is necessary for the required tilting stability can be used. The increase in lift results because the band member does not butt against at least one end but is deflected so that the lifting rail which is installed for instance in the longitudinal center of the band can be advanced up to approximately the deflection point.

A maximum tilting stability is achieved when the length of the band member corresponds at least approximately to the length of the guide rail and the lifting rail in the area of the longitudinal center of the band member is connected with the latter.

In a particularly simple embodiment, the guide rail is constructed as a C-rail which engages around the band member and which preferably has a transversely extending insertion slot for the band member.

The invention is elucidated below with the aid of two exemplified embodiments. In the drawing FIG. 1 shows a schematic front view of a window lifting mechanism according to the invention.

FIG. 8 is a partial sectional view of another embodiment of the band member used in the window lifting mechanism.

FIG. 9 is a partial elevational view of a further embodiment of the band member.

FIG. 10 is a sectional view taken along lines X—X in FIG. 9.

Figure 1:
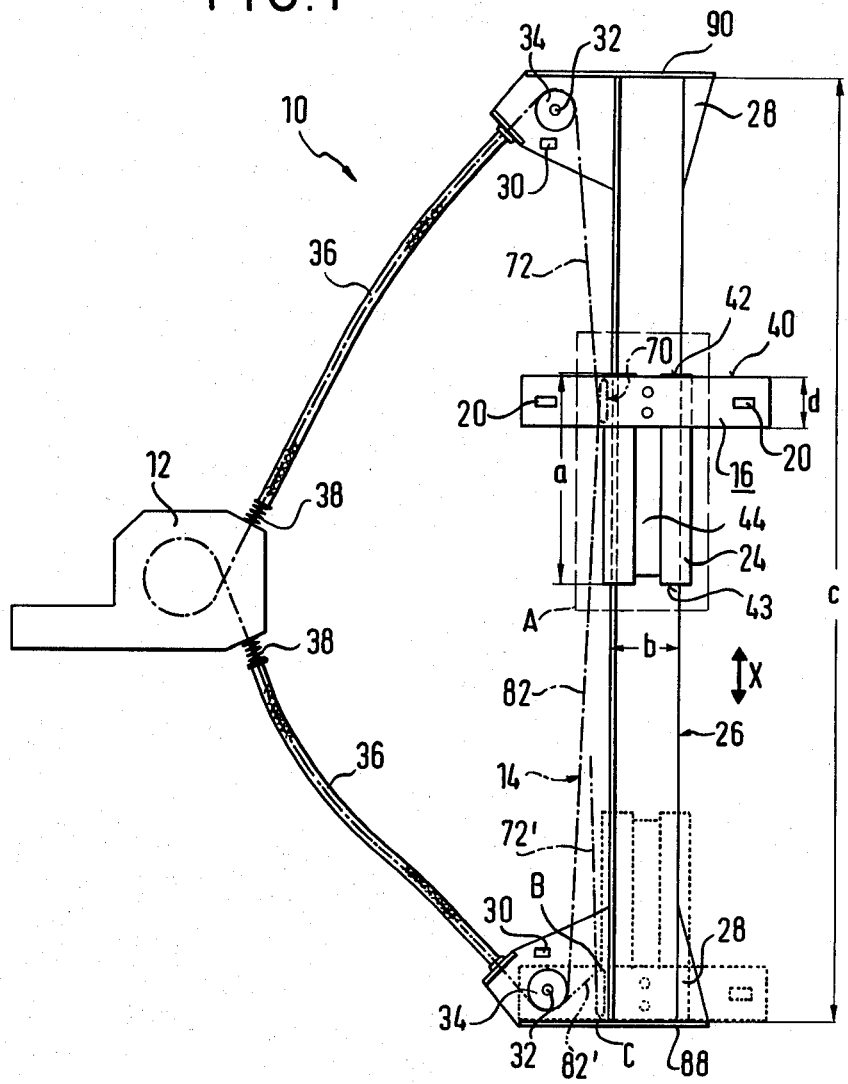

The cable window lifting mechanism 10 shown schematically in FIG. 1 is comprised of a cable drive 12 (hand crank or electric motor drive) which moves a traction cable 14—shown with a dash-dot line—back and forth along a closed cable loop. The traction cable 14 engages at an engagement plate 16 which is rigidly connected with an essentially U-shaped lifting rail 18, for instance by means of screw connections which engage into fastening holes 20 of the engagement plate; the lifting rail is only shown in FIG. 3. The lifting rail 18 in turn engages around the lower cross edge of a window pane 22.

The engagement plate 16 is supported at a slide member 24 which, in turn, can be moved back and forth in the longitudinal direction X at a guide rail 26 (see FIG. 4) which is L-shaped in the cross-section.

At both ends of the guide rails 26, always one fastening plate 28 is installed, for instance riveted on or welded on, which serves for attachment of the guide rail at a sheet metal plate of the vehicle door. In FIG. 1, fastening holes 30 of the fastening plate 28 which are intended for this purpose are indicated. The fastening plates 28 carry always one bearing bolt 32 for a cable deflecting roller 34. The traction cable 14 extends, starting from the cable drive 12, always through a Bowden wire casing 36 to the cable deflecting rollers and subsequently to the engagement plate 16. For cable tensioning always retightening springs 38 are provided in the area of the ends of the two Bowden wires 36 which are close to the cable drive.

During operation of the window lifting mechanism 10, particularly at a unilateral guidance of the window pane, window tilting moments occur in the window plane which are to be absorbed, if possible, by the guide rail 26 and thus by the motor vehicle door so that the window pane 22 does not tilt. In order to keep the concentrated loads which occur at large tilting moments and act between the slide member 24 and the guide rail 26 at a minimum, the length a of the slide member 24 is determined as a multiple, for instance approximately five times, the width b of the guide rail (see FIG. 1). Hereby deformations, particularly of the guide rail 26, as well as a high friction which impairs the easy motion are prevented.

At a given length c of the guide rail 26, which is limited by the provided installation space in a motor vehicle door, at an engagement plate 16 which is rigidly connected with the slide member 24 a window lifting mechanism lift can be achieved which at the maximum equals c−a. In order to increase the lift at a specified guide rail length c beyond this value, the engagement plate 16 is slidably supported in direction X at the slide member 24, i.e. between an upper end position of the engagement plate 16 relative to the slide member 24 in which the upper cross edge 40 of the engagement plate 16 lies at the same elevation as the upper cross edge 42 of the slide member 24, as shown in FIG. 1, and in a lower end position which is indicated in FIG. 1 with a dotted line and in which accordingly the lower cross edges lie on the same elevation. The now achievable maximum lift is therefore equal to c−d, wherein d represents the width of the engagement plate 16 measured in the direction X. d is approximately a third of a.

Figure 4:
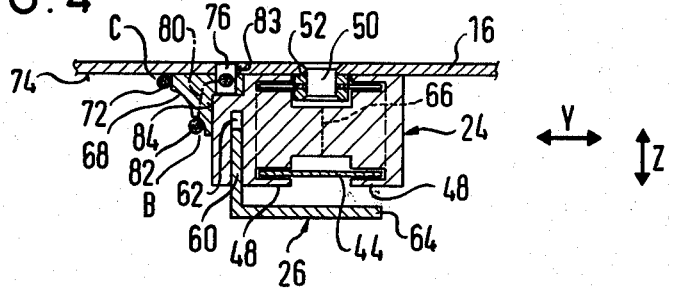
FIG. 4 shows a view of the detail according to FIG. 2 in section along line IV—IV.
Figure 3:
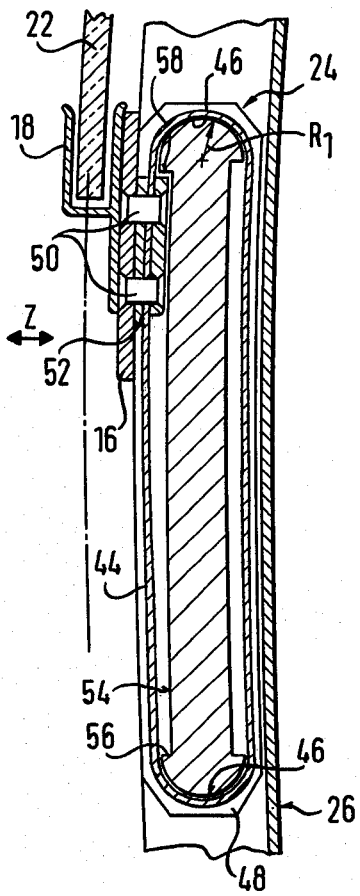
FIG. 3 shows a view of the detail A according to FIG. 2 in section along line III—III.
Figure 2:
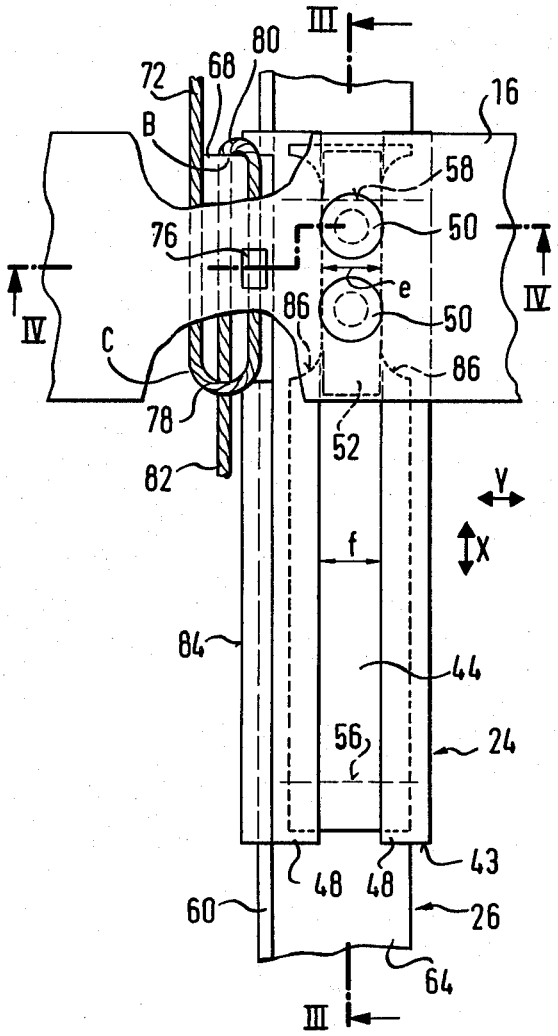
FIG. 2 shows an enlarged front view of the detail A in FIG. 1.

In FIGS. 2 to 4, the linear guidance is shown in detail with which the engagement plate 16 is slidably supported in direction X at the slide member 24. The linear guidance is comprised of a steel band member 44 which is guided in a closed band loop around the slide member 24 and has a loop axis which is parallel to the lifting rail 18 (direction Y in FIG. 2). The slide member 24 is provided at its two longitudinal ends with semicylindrical end sections 46 around which the band member 44 extends. Due to the relatively large semicylindrical radius $R_1$, an easy movement of the band member 44 around the sliding member 24 is guaranteed. The longitudinal edges of the band member 44 are engaged by always one revolving guide strip 48 of the slide member 24, so that a shifting of the band member 44 in direction towards its loop axis is excluded, as is a twisting or bending of the band member under high stresses, particularly tilting stresses. Such stresses are transferred by the engagement plate 16 onto the band member 44 by means of two rivets 50 which are arranged offset in direction X and penetrate the engagement plate 16 as well as the band member 44 as well as a guide web 52 which is installed at the band member 44 (see FIGS. 3 and 4). The guide web 52 is molded onto both sides of the band member 44. The portion of the guide web 52 which extends between the band member 44 and the engagement plate 16 is fitted into the space between the guide strips 48. The portion of the guide web 52 which is arranged on the other side of the band member 44 projects into a guide groove 54 of the slide member 24. In FIGS. 2 and 3, the lower cross edge of the guide groove 54 is identified with 56. This cross edge 56 forms a lower motion stop for the guide web 52 and thus the engagement plate 16. Accordingly, the upper cross edge 58 of the guide groove 54 serves as the upper motion stop.

For guidance of the slide member 24 at the guide rail 26, a side 60 of the guide rail 26 which extends upwardly in FIG. 4 engages into a correspondingly fitted groove 62 of the slide member 24. In order to exclude lifting of the slide member 24 out of the guide rail 26, a not shown guide lug may be provided at the slide member 24 which engages at the underside of the other side 64 of the guide rail 26.

The slide member 24 can be constructed economically as an injection molded part, if necessary in two parts with a junction plane 66 which extends in the center, is perpendicular to the direction Y and is indicated with a dotted line in FIG. 4.

At the engagement plate 16, a traction cable fastener 68 is molded on, as can be seen in FIGS. 2 and 4, around which a loop 70 of the traction rope 14 is placed in such a way that the rope section 72 which comes from the upper deflecting roller 34 in FIG. 1 continues in a partial loop 78 which rests against the underside 74 of the engagement plate 16. After passage through a cable nipple 76 an additional partial loop 80 follows the partial loop 78. From the partial loop 80 the cable section identified with 82 which extends between the engagement plate 16 and the lower deflecting roller 34 runs off. As can be concluded from FIGS. 2 and 4, the loop axis of the partial loop 80 extends to the top left in FIG. 4 at an approximately equal deflection radius as in the partial loop 78 so that as a result the cable section 82 which runs off the fastener 68 is offset perpendicularly to the plane of the window pane with respect to the cable section 72 which runs off the fastener in direction Y as well as in direction Z. As will be explained below, this offset arrangement guarantees that the cable sections 72 and 82 always cross at a distance from one another and also do not abut in a corresponding end position of the window lifting mechanism at the deflecting roller 34 which is associated with always the other cable section.

For the reliable, force-locking connection between the traction cable 14 and the engagement plate 16, the cable nipple 76 is fitted into a recess 83 in the engagement plate 16. In order to further improve the guidance of the engagement plate 16 at the slide member 24, the fastener 68 lies flat at a guide surface 84 of the slide member 24, which guide surface is Z-shaped in the cross-section (FIG. 4).

If the alignment and/or the shape of the guide rail 26 does not exactly coincide with the corresponding lateral window guidances, particularly in strongly curved window panes, the possibility of a relative motion between the lifting rail 18 and the guide rail 26 should exist in the direction perpendicular to the plane of the window pane, i.e. in direction Z. In order to make this possible, the band member 44 is provided in the area of the guide web 52 with recesses 86 at both longitudinal edges in such a way that the resulting width e of the band member 44 is slightly smaller than the inside distance f between the guide strips 48 which corresponds to the width of the guide groove 54. The band member 44 consequently can enter in the connection area with the engagement plate 16 as well as between the guide strips 48, and can also penetrate into the guide groove 54 which is made possible by means of a correspondingly deep groove bottom of the guide groove 54. Therefore there is the possibility of a relative motion of the lifting rail 18 in direction of the double arrow Z in FIG. 3 compared to the slide member 24. Since the narrow area of the band member is shorter than the width d of the engagement plate 16, nevertheless an adequate stability against tilting moments is guaranteed.

During a movement of the window lifting mechanism out of one of its end positions, at the beginning of the movement the slide member 24 is taken along by the engagement plate 16 because the frictional force which acts between the engagement plate 16 and the slide member 24 exceeds the frictional force which acts between the slide member 24 and the guide rail 26. FIG. 1 shows an intermediate position during the movement of the window lifting mechanism 10 from its upper end position to its lower end position. During the continued movement, the lower cross edge 43 of the slide member 24 finally comes in contact at a stop web 88 which is provided at the lower end of the guide rail (90 is the upper stop web). Now the engagement plate 16 moves alone farther downwardly into the lower end position which is shown with a dotted line in FIG. 1. This is also possible because, due to the loop-shaped attachment of the traction cable 14 at the fastener 68, the cable starting point B of the traction cable section 82' which leads to the lower cable deflecting roller 34 lies in the area of the upper cross edge 40 of the engagement plate 16. The same applies for the traction cable section 72' which leads to the upper cable deflecting roller 34 and which originates from a lower cable starting point C. Due to this "crossed arrangement", the traction cable 14 always exercises also in the end positions of the window lifting mechanism an adequately large component of force, which lies in the direction X, on the engagement plate 16. Due to the offsetting of the starting points B and C in a plane which is perpendicular to the direction X, explained in FIG. 4, no mutual hindrance of the crossing cable sections 72 and 82 nor abutting of a cable section at the deflecting roller which is provided for the other cable section occurs.

During a movement of the window lifting mechanism into its upper end position, the sequence of motion is accordingly.

Figure 7:
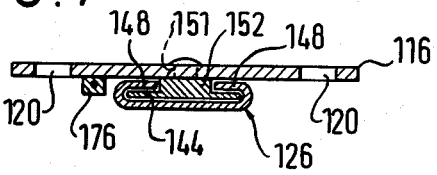
FIG. 7 shows the arrangement according to FIGS. 5 and 6 in section along line VII—VII.
Figure 6:
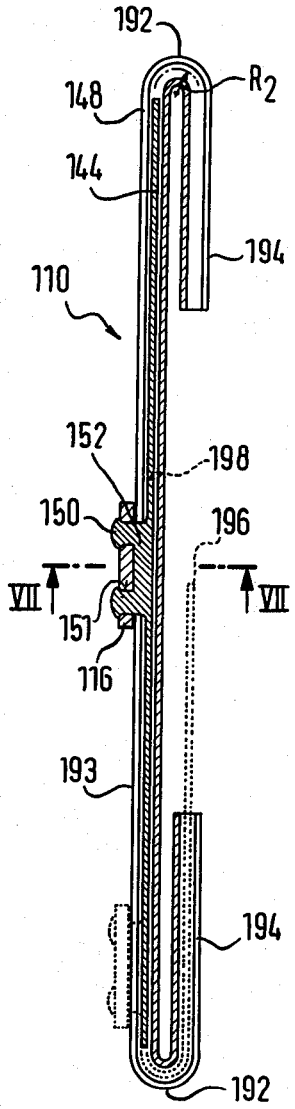
FIG. 6 shows the arrangement according to FIG. 5 in section along line VI—VI.
Figure 5:
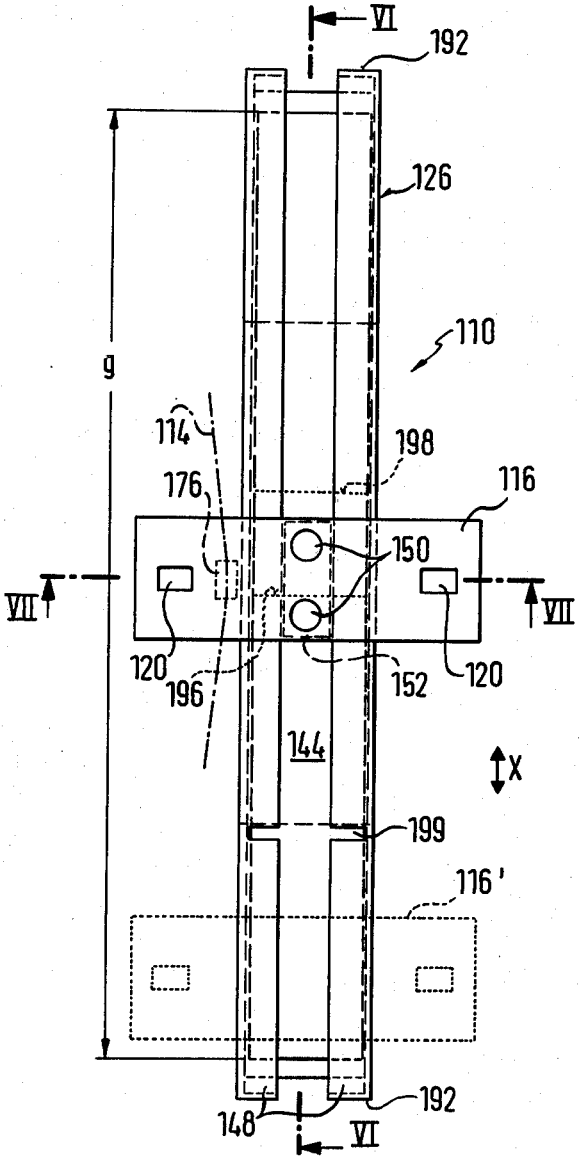
FIG. 5 shows a schematic front view of another embodiment of the window lifting mechanism according to the invention and the cable drive is omitted.

In the additional embodiment of a cable window lifting mechanism which is identified with 110 and shown in FIGS. 5 to 7, the parts which correspond to those of the cable window lifting mechanism 10 according to FIGS. 1 to 4 are identified with the same reference numbers, always adding 100. The engagement plate 116 with the fastening holes 120 for a not shown lifting rail carries a cable nipple 176 for a traction cable 114. The cable nipple is attached in a not further shown type and manner at the engagement plate 116. In order to provide an adequate tension even in the end positions of the window lifting mechanism, however also a part which corresponds to the described traction cable fastener 68 can be installed at the engagement plate 116 with a traction cable which is accordingly guided to form a loop.

The steel band member 44 which is inserted in the above-described embodiment for transfer of the pitching moments is now slidably supported directly at the guide rail 126 which for this purpose is constructed as a C-rail according to FIG. 7. The sides 148 of the C-rail shaped guide rail 126 which correspond to the guide strips 48 engage around the longitudinal edges of the band member 144.

The band member 144 is constructed as a plastic band, provided if necessary with an interior steel or textile reinforcement. However, also a steel band as in the first-described embodiment may be used. In the area of attachment of the engagement plate 116 at the band member 144, the latter is constructed with a sprayed-on guide web 152 from which two fastening pegs 150 project which are arranged offset in direction X and which penetrate corresponding fastening holes 151 of the engagement plate 116 and which are widened in rivet head form at the outside of the engagement plate to form a support.

The length g of the band member 144 corresponds essentially to the length c of the guide rail 126. The engagement plate 116 is attached in the area of the longitudinal center of the band member 144 at the latter.

In the area of its two ends, the guide rail 126 is provided with always one band deflection 192 for the band member 144. These band deflections 192 consist merely of an approximately 180° bent of one end of the guide rail 126, wherein attention must be paid that at the bent-over area there remains an adequate space for movement of the band member 144. The angle of bent as well as the length of the respective bent end piece 194 is not critical because it is primarily important to deflect the band member 144 in the installation space which is available in a motor vehicle door.

In the central window lifting mechanism position which is shown in FIGS. 5 and 6, the band member 144 fills out exactly the length of the guide rail 126. If now the window lifting mechanism is moved for instance into its lower end position, then the lower end of the band member 144 reaches the lower deflection 192 of the guide rail 126. Due to its flexibility, the end of the band member follows the curvature of the deflection and reaches the end piece 194 of the guide rail 126. In the lower end position of the window lifting mechanism, which is indicated with a dotted line, the engagement plate 116' is directly in front of the deflection 192. The bent section of the band member 144 projects upwardly beyond the open end of the end piece 194. The cross edge of this bent member end is identified in FIGS. 5 and 6 with 196, the cross edge of the band member end inside the guide rail 126 is identified with 198. It is evident that in this end position a section of the band member 144 whose length is greater than half the entire length g of the band member 144 is still arranged inside the actual guide rail, i.e. in the guide rail section 193 between the deflections 192. Consequently also in this end position an adequate stiffness of the arrangement with respect to tilting motions of the plane of the window pane is guaranteed. The same applies for the upper end position of the cable window lifting mechanism.

In order to increase the respective effective length of the band member in the end positions of the window lifting mechanism, also a band member with a correspondingly greater total length can be used. In addition, also a band member in form of a closed band loop may be used in accordance with the embodiment according to FIGS. 1 to 4.

The guide rail 126 may be a sheet metal section, however also a cast or continuous cast construction is possible.

In those cases in which an insertion of the band member 144 from one of the end pieces 194 is not possible, for instance when the guide web 152 is not sufficiently flexible, an insertion slot 199 may be provided in the guide rail section 126 between the deflections 192, which slot extends transversely to the longitudinal direction as indicated in FIG. 5.

The band member 144 can be provided for reinforcement with ribs in the manner of a toothed belt, which extend transversely to the longitudinal direction of the band. Alternatively or additionally the band can also be upset transversely to the longitudinal direction to increase its strength.

Instead of a single band member 44 or 144, also in the above-described embodiments two or more band members, appropriately modified, can be inserted which in this case would have to be arranged at the same height, next to one another. Several band members offer compared to one single, correspondingly thicker band member the advantage that they are easier to bend. The bending radius $R_1$ according to FIG. 3 and $R_2$ according to FIG. 6 can be kept accordingly small which reduces the structural height in direction Z. The use of plastic bands is to be preferred when a limited friction and limited manufacturing expenditure are important. In FIG. 8 the band member 44' is formed of three steel bands **44*a*, 44*b* and 44*c*. An alternate embodiment is shown in FIGS. 9 and 10 where the band member 44'' is a plastic band reinforced by transverse ribs 45**.

I claim:

1. A window lifting mechanism, particularly for motor vehicles, with a lifting rail (18) which engages at a window pane (22), a slide member (24) which is connected with said lifting rail (18) and is slidably supported at a guide rail (26), and a drive (12) which acts on said lifting rail (18) and moves said lifting rail (18) along said guide rail (26), wherein said lifting rail (18) is slidable with respect to said slide member (24) essentially in the longitudinal direction (X) of said guide rail (26) by means of a linear guidance which connects said lifting rail (18) and said slide member (24), said linear guidance being of essentially rigid construction with respect to the tilting motions of said lifting rail (18) which lie in the plane of said window pane and act relative to said slide member (24), characterized by at least one bearing part which is attached at said lifting rail (18) and is supported to be slidable at said slide member (24) in the longitudinal direction (X) of said guide rail (26).

2. A window lifting mechanism according to claim 1, characterized in that said bearing part is constructed oblong in the longitudinal direction (X) of said lifting rail (18) and that at least one of the longitudinal ends of said bearing part are constructed to be deflectable around the corresponding, closest longitudinal end of said slide member (24).

3. A window lifting mechanism according to claim 2, characterized in that said bearing part is formed by a deformable band member (44) which at least in the area of said lifting rail (18) lies essentially in a plane which is parallel to the plane of said window pane.

4. A window lifting mechanism according to claim 3, characterized in that said band member (44) is formed by several thin steel bands which are placed one above another.

5. A window lifting mechanism according to claim 3, characterized in that said band member (44) is formed by a plastic band which is reinforced by transverse ribs.

6. A window lifting mechanism according to claim 3, characterized in that said band member (44) is formed by a plastic band which is reinforced by upsetting said band in the transverse direction.

7. A window lifting mechanism according to claim 3, characterized in that at said engagement plate (16) a traction cable fastener (68) is installed.

8. Window lifting mechanism according to claim 3, characterized in that said band member (44) is formed by one thin steel band.

9. A window lifting mechanism according to claim 3 or 8, characterized in that said band member (44) forms a closed band loop with a loop axis which is essentially parallel to the longitudinal direction (Y) of said lifting rail.

10. A window lifting mechanism according to claim 3, characterized in that said band member (44) on the side of said slide member (24) which faces said lifting rail (18) is guided by means of guide strips (48) which engage over the longitudinal edges of said band.

11. A window lifting mechanism according to claim 10, characterized in that said band member (44) in the area of its attachment to said lifting rail (18) is provided at both longitudinal edges with recesses (84) in such a way that the resulting width (e) of said band is less than the inside distance (f) between said guide strips (48).

12. A window lifting mechanism according to claim 10 or 11, characterized in that said band member (44) in the area of its attachment at said lifting rail (18) is provided with a guide web (52) which is fitted between said guide strips (48).

13. A window lifting mechanism according to claim 12, characterized in that said guide web (52) which is preferably molded on said band member (44) also projects on the side of said band member which faces away from said lifting rail (18) beyond said band member (44) and engages into a guide groove (54) which is constructed at said slide member (24).

14. A window lifting mechanism according to claim 3, characterized in that said lifting rail (18) is provided with an engagement plate (16) which is attached to said band member (44) and is constructed in one piece, if necessary, with said lifting rail (18).

15. A window lifting mechanism according to claim 3, characterized in that at said lifting rail (18) a traction cable fastener (68) is installed.

16. A window lifting mechanism according to claim 15, characterized in that around said traction cable fastener (68) a loop (70) of a traction cable (14) is placed with cable starting points (B,C) which are arranged offset with respect to one another in a plane which is perpendicular to the longitudinal direction (X) of said lifting rail (18).

17. A window lifting mechanism according to claim 11, characterized in that said traction cable fastener (68) rests at at least one guide surface (84) of said side member (24), said guide surface being perpendicular to the plane of said window pane and parallel to the longitudinal direction (X) of said guide rail (26).

18. A window lifting mechanism according to claim 15 or claim 7 wherein said traction cable fastener is molded on.

19. A window lifting mechanism particularly for motor vehicles, with a lifting rail (18) which engages at a window pane (22), a slide member (24) which is connected with said lifting rail (18) and is slidably supported at a guide rail (26), and a drive (12) which acts on said lifting rail (18) and moves said lifting rail (18) along said guide rail (26), wherein said lifting rail (18) is slidable with respect to said slide member (24) essentially in the longitudinal direction (X) of said guide rail (26) by means of a linear guidance which connects said lifting rail (18) and said slide member (24), said linear guidance being of essentially rigid construction with respect to the tilting motions of said lifting rail (18) which lie in the plane of said window pane and act relative to said slide member (24), characterized in that said slide member is formed by a band member (144) supported to be slidable directly at said guide rail (126), and that at at least one of the ends of said guide rail (126) a band deflection (192) is provided.

20. A window lifting mechanism according to claim 19, characterized in that said guide rail (126) is constructed as a C-rail which engages around said band member (144).

21. A window lifting mechanism according to claim 20, characterized in that said guide rail (126) has an insertion slot (199) for said band member (144), said insertion slot extending transversely to the longitudinal direction (X) of said guide rail (126).

22. A window lifting mechanism according to one of the claims 19, 20 or 21, characterized in that the length (g) of said band member (144) corresponds at least approximately to the length (c) of said guide rail (126), and that one of said lifting rail and said engagement plate (116) in the area of the longitudinal center of said band member (144) is connected with the latter.

* * * * *